US006138983A

United States Patent [19]

Sievert

[11] Patent Number: 6,138,983

[45] Date of Patent: Oct. 31, 2000

[54] MOLD FOR PRODUCING MASONRY BLOCK WITH ROUGHENED SURFACE

[75] Inventor: Dick J. Sievert, New Richmond, Wis.

[73] Assignee: Anchor Wall Systems, Inc., Minnetonka, Minn.

[21] Appl. No.: 09/198,177

[22] Filed: Nov. 23, 1998

Related U.S. Application Data

[62] Division of application No. 08/748,498, Nov. 8, 1996, Pat. No. 5,879,603.

[51] Int. Cl.[7] ..... B28B 7/10; B28B 7/14

[52] U.S. Cl. ..... 249/114.1; 249/140; 249/161; 425/304; 425/443

[58] Field of Search ..... 425/304, 436 R, 425/441, 443; 249/52, 55, 114.1, 117, 140, 161

[56] References Cited

U.S. PATENT DOCUMENTS

| | | |
|---|---|---|
| 831,077 | 9/1906 | Johnson . |
| 1,219,127 | 3/1917 | Marshall . |
| 1,287,055 | 12/1918 | Lehman . |
| 1,465,608 | 8/1923 | McCoy . |
| 1,534,353 | 4/1925 | Besser . |
| 1,557,946 | 10/1925 | Smith . |
| 1,751,028 | 3/1930 | Caswell et al. . |
| 1,872,522 | 8/1932 | Stuckey . |
| 1,993,291 | 3/1935 | Vermont . |
| 2,011,531 | 8/1935 | Tranchell . |
| 2,121,450 | 6/1938 | Sentrop . |
| 2,313,363 | 3/1943 | Schmitt . |
| 2,570,384 | 10/1951 | Russell . |
| 3,185,432 | 5/1965 | Hager, Jr. . |
| 3,204,316 | 9/1965 | Jackson . |
| 3,378,885 | 4/1968 | Dart . |
| 3,386,503 | 6/1968 | Corning et al. . |
| 3,659,077 | 4/1972 | Olson . |
| 3,936,989 | 2/1976 | Hancock . |
| 3,940,229 | 2/1976 | Hutton . |
| 3,981,953 | 9/1976 | Haines . |
| 4,023,767 | 5/1977 | Fontana . |

(List continued on next page.)

FOREIGN PATENT DOCUMENTS

| | | |
|---|---|---|
| 1040452 | 10/1978 | Canada . |
| 2012286 | 9/1991 | Canada . |
| 0 490 534 | 6/1992 | European Pat. Off. . |
| 0 649 714 | 4/1995 | European Pat. Off. . |
| 2 622 227 | 12/1989 | France . |
| 456776 | 4/1950 | Italy . |
| 944066 | 12/1963 | United Kingdom . |
| 970595 | 9/1964 | United Kingdom . |
| 2 213 095 | 8/1989 | United Kingdom . |

OTHER PUBLICATIONS

Besser, "Technical Data for the Blockmaker", *Besser Research and Training Center,* pp. 33–34 (1962).

Besser, "Concrete Paving Stones", *Manual No. 8601—Section 5, Besser Company,* pp. 1–24.

Besser, "Parts and Equipment," *Besser Company,* pp. 1–80 (before 1990).

Christie, N. et al., "Australian Concrete Masonry, Design and Construction", (1976).

Kawano, "Cement Brochure", (date unknown).

PISA II, "Interlocking Retaining Wall Sysem", *Intelock Paving Company* (1988).

Pfeiffenberger, L., "Review of Paver Production on Besser Block Machines", pp. 33–37 (2 parts)(1984).

*Primary Examiner*—James P. Mackey

*Attorney, Agent, or Firm*—Merchant & Gould P.C.

[57] ABSTRACT

A mold for producing a masonry unit with a roughened texture side surface having a plurality of side walls defining a mold cavity open at its top and bottom, adapted to receive masonry fill material by way of its open top, and to discharge molded fill material in the form of a block of predetermined height by way of its open bottom; and opposed, inwardly extending generally parallel upper and lower lips along at least one of said side walls, the upper lip being located at a predetermined height above the lower lip and the lower lip being located at the bottom of the mold cavity.

8 Claims, 3 Drawing Sheets

U.S. PATENT DOCUMENTS

| | | |
|---|---|---|
| 4,098,865 | 7/1978 | Repasky . |
| 4,193,718 | 3/1980 | Wahrendorf et al. . |
| 4,207,718 | 6/1980 | Schaaf et al. . |
| 4,218,206 | 8/1980 | Mullins . |
| 4,238,105 | 12/1980 | West . |
| 4,335,549 | 6/1982 | Dean, Jr. . |
| 4,659,304 | 4/1987 | Day . |
| 4,721,847 | 1/1988 | Leopold . |
| 4,784,821 | 11/1988 | Léopold . |
| 4,802,836 | 2/1989 | Whissell . |
| 4,896,472 | 1/1990 | Hunt . |
| 4,909,717 | 3/1990 | Pardo . |
| 5,017,049 | 5/1991 | Sievert . |
| 5,062,610 | 11/1991 | Woolford et al. . |
| 5,078,940 | 1/1992 | Sayles . |
| 5,139,721 | 8/1992 | Castonguay et al. . |
| 5,158,132 | 10/1992 | Guillemot . |
| 5,217,630 | 6/1993 | Sayles . |
| 5,249,950 | 10/1993 | Woolford . |
| 5,261,806 | 11/1993 | Pleasant . |
| 5,294,216 | 3/1994 | Sievert . |
| 5,484,236 | 1/1996 | Gravier . |
| 5,490,363 | 2/1996 | Woolford . |
| 5,622,456 | 4/1997 | Risi et al. . |
| 5,704,183 | 1/1998 | Woolford . |

FIG. 1
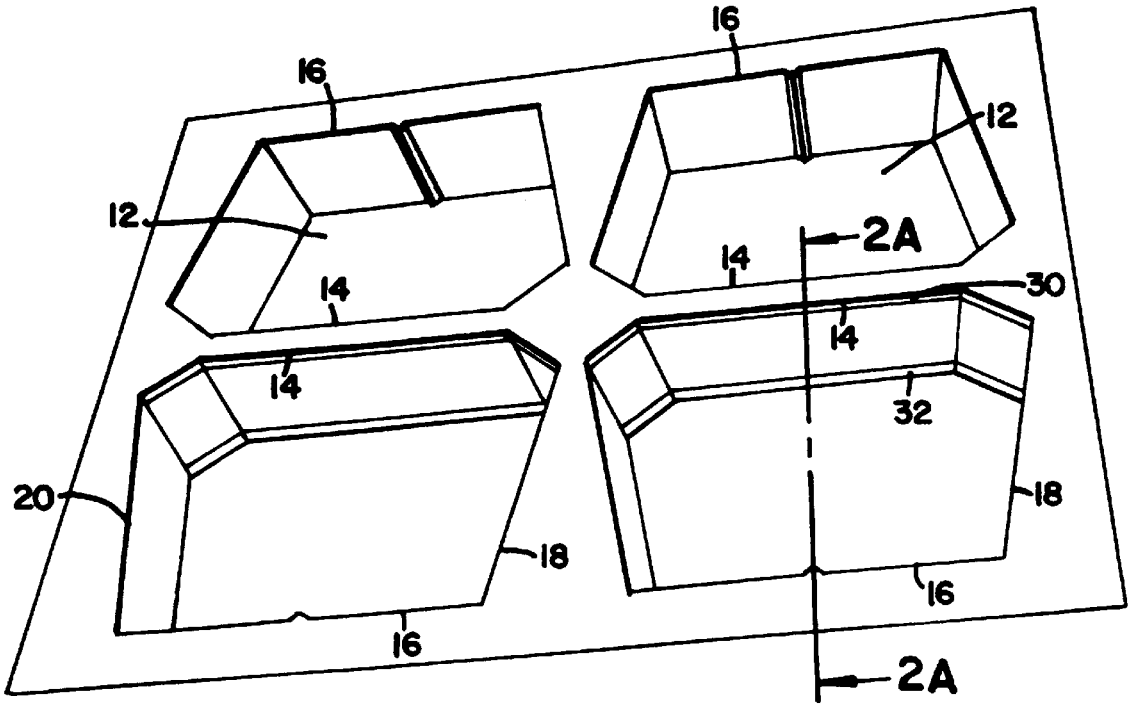
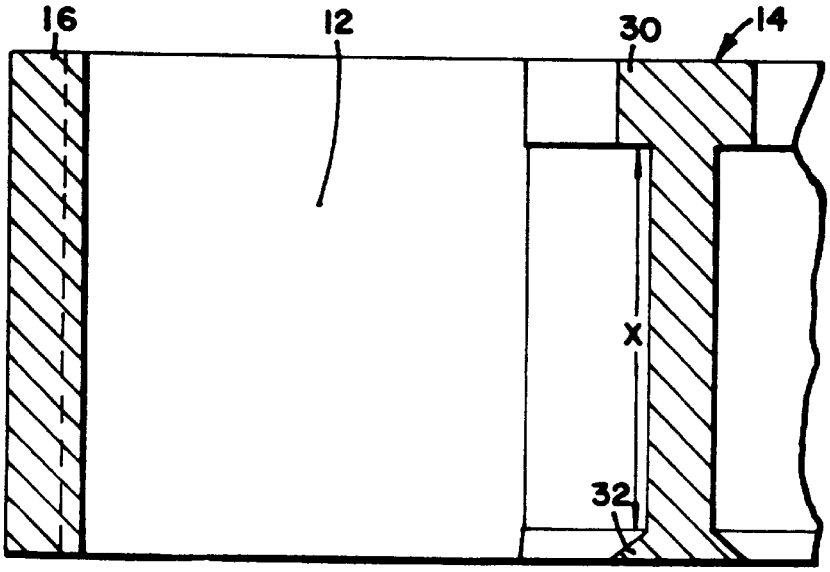
FIG. 2A

FIG. 2B
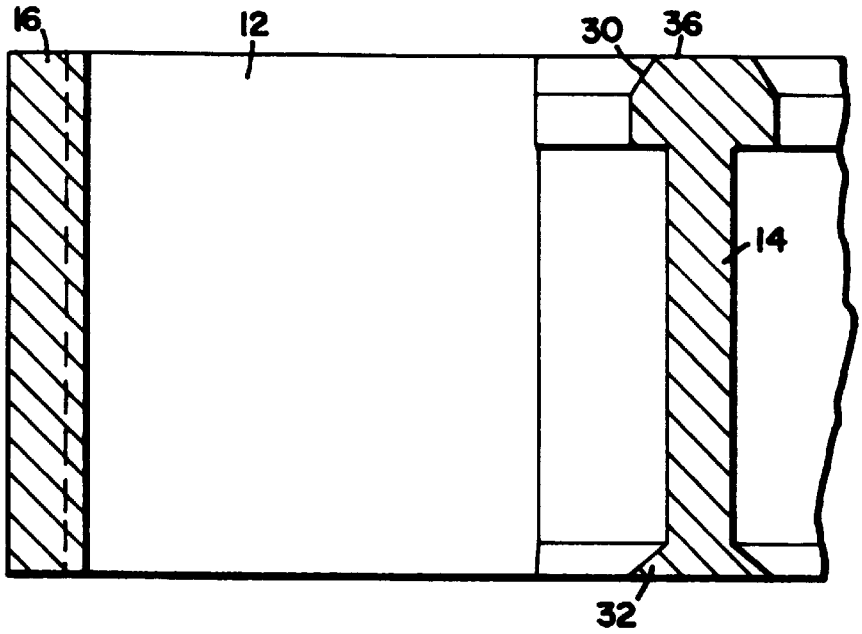
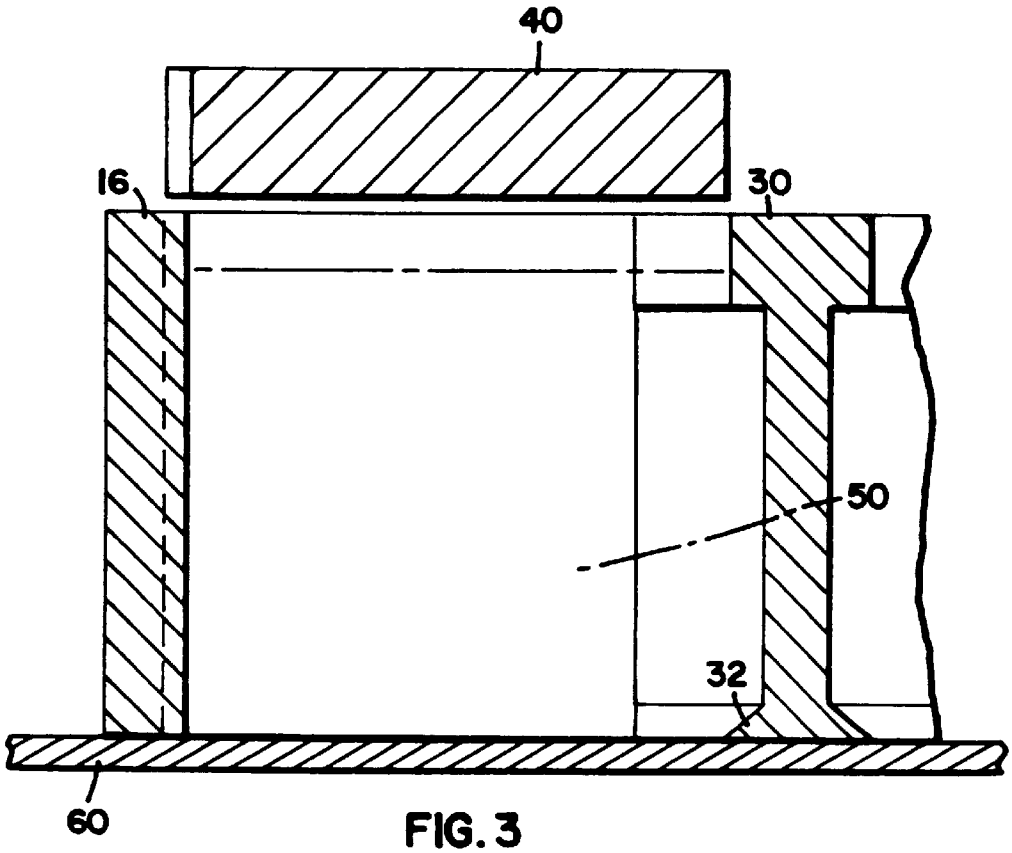
FIG. 3

FIG.4
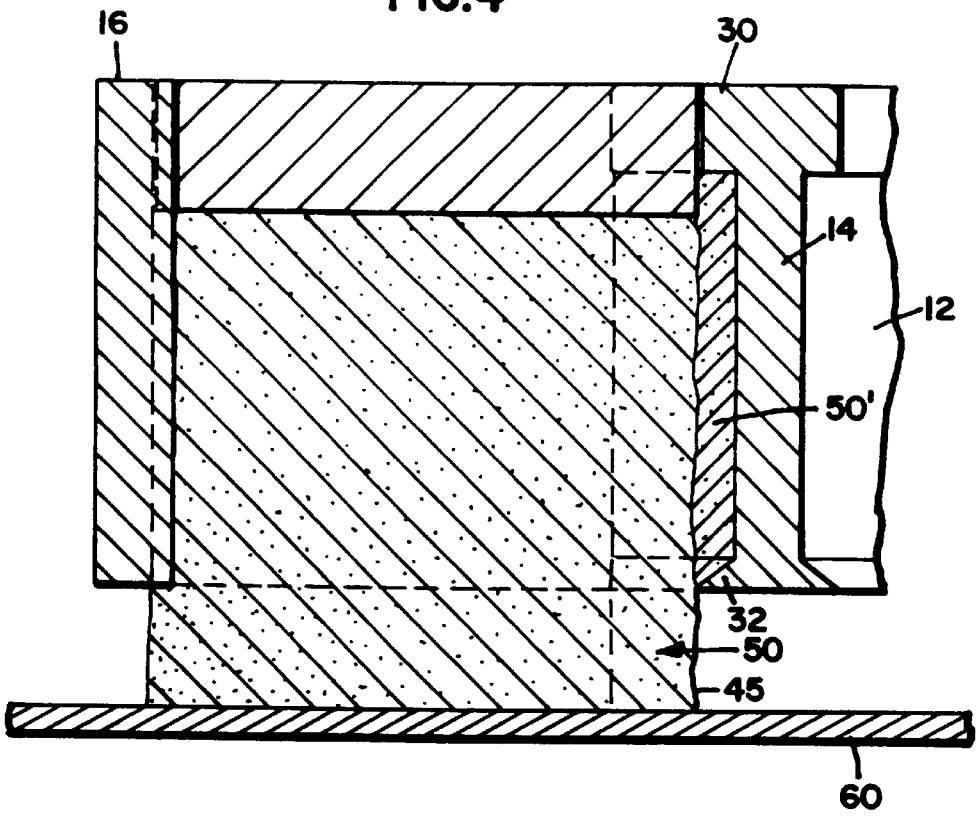
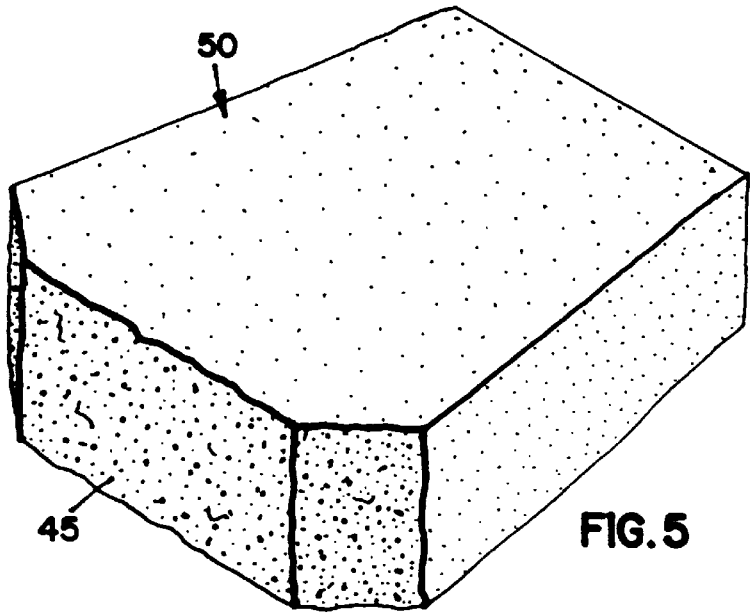
FIG.5

MOLD FOR PRODUCING MASONRY BLOCK WITH ROUGHENED SURFACE

This application is a division of Ser. No. 08/748,498, filed on Nov. 8, 1996, now U.S. Pat. No. 5,879,603.

BACKGROUND OF THE INVENTION

I have experimented with molds of the type described in U.S. Pat. No. 3,940,229 for the purpose of making concrete masonry units with a roughened texture on at least one face. In this type of mold, one of the walls of the mold includes an inwardly extending lip on the lower edge of the wall. The specification of the '229 patent describes this lower lip as producing a scraping or tearing action on the adjacent surface of the green concrete masonry unit as it is stripped from the mold, to produce a roughened texture on the finished product. In my observation, the lower lip acts by retaining a portion of the fill material in place against at least a portion of the associated mold wall as the mold is stripped. Thus the lip catches some of the aggregate in the material, and pulls, or rolls, it up the side of the green block as it is stripped from the mold, thus causing the roughened surface.

As I experimented with this mold, the thought occurred to me that I might get an improved roughened face if I positioned an upper lip along the same wall carrying the lower lip. My thought was that an upper lip of the same depth as the lower lip, positioned just at the compacted fill level of the mold cavity, might block fill from "squirting" out between the mold wall and the stripper shoe as the mold was stripped from the block. Of course, the more I thought about this, I realized that, as the mold was stripped, this upper lip would be moving progressively further away from the molded block, so that the effect which I at first envisioned couldn't occur as I envisioned it. Nonetheless, I decided to experiment by positioning an upper lip as described.

When I produced blocks in the mold with the additional upper lip, it appeared to me that a somewhat rougher-textured block was produced than was produced in the mold without the upper lip. To date, I have no definitive explanation for why this occurs. My present theory is that the upper lip somehow interacts with the mold vibration to produce more compaction of the material adjacent the associated wall than is the case when no upper lip is employed, and that this improved compaction at the wall enhances the roughening effect of the lower lip. This is consistent with my observation of the mold cavity immediately following stripping of the mold. In the case of a mold having only a lower lip, I observed that some of the fill material remained adhered to the end wall above the lower lip. This material extended approximately halfway up the wall along its entire length, and was somewhat discontinuous in its coverage. In the case of a mold having both an upper and a lower lip, I observed that more fill material remained adhered to the end wall between the upper and lower lips, that it was a thicker, more compacted layer of material, and that it was more continuous in its coverage. In both cases, when a new pallet is positioned against the bottom of the mold—the pallet typically slaps the bottom of the mold as it moves into position—the material adhering to the end wall is generally knocked loose from the wall.

Not only did the upper lip act to produce a somewhat rougher surface, but it also provided a useful alignment guide for positioning of the stripper shoe, so that it would not interfere with the lower lip as the mold is stripped.

I am also aware of U.S. Pat. Nos. 5,078,940 and 5,217,630, which also describe a mold like that shown in the '229 patent having a lower lip on one wall to produce a rough textured surface on a concrete masonry unit. The '940 and '630 patents describe the use of a screen and a series of projections on the mold wall to hold fill material against the wall as the mold is stripped. I believe that maintenance of such a screen would prove difficult in a typical production environment, and that the use of such a screen and projections would result in a mold that is not self-cleaning, and will require frequent stoppages in production to clear before material becomes unacceptably hard against the wall.

My mold does not have either of these problems.

SUMMARY OF THE INVENTION

My invention is a mold for producing a masonry unit with a roughened texture side surface. The mold has a plurality of side walls defining the mold cavity. The mold cavity is open at its top and bottom and adapted to receive masonry fill material by way of its open top. The mold is also adapted to discharge molded fill material by way of its open bottom in the form of blocks of a predetermined height. After the mold is filled, the fill material is compacted by vibration and the action of a stripper shoe plate to a predetermined, compacted level corresponding with the finished height of the finished block. The mold also includes opposed, inwardly extending upper and lower lips along at least one of the side walls. The upper lip is located at about the predetermined compacted fill level of the mold cavity. The lower lip is located at the bottom of the mold cavity.

My invention provides a low maintenance, selfcleaning mold for production of concrete block with roughened surfaces without the use of means such as block splitters. Additionally, the use of an upper lip aids in properly aligning the stripper shoe head.

BRIEF DESCRIPTION OF THE DRAWINGS

FIG. 1 is a perspective view of a mold.

FIG. 2A is a sectional view of the mold shown in FIG. 1 taken at line 2A—2A.

FIG. 2B is a sectional view of an alternative embodiment of the mold shown in FIG. 1, having a bevelled upper lip.

FIG. 3 is a sectional view of the mold shown in FIG. 2 additionally showing the action of a stripper shoe converging on the filled cavity.

FIG. 4 is a sectional view of the mold shown in FIG. 2 showing the action of the stripper shoe head compressing the mold fill and stripping the block from the mold.

FIG. 5 is a perspective view of a block made with the process of the invention.

DETAILED DESCRIPTION OF THE INVENTION

My invention is a mold for producing a masonry unit or block with a roughened texture side surface without the use of apparatus such as splitters. My invention may be used with any number of different types of molds to produce any variety of blocks. An example of my mold 10 can be seen in FIG. 1. The mold may have a single cavity 12 or, as can be seen in FIG. 1, multiple cavities. Side walls 14, 16, 18, 20 define the mold cavity 12. The mold is open at its top and bottom. The mold is adapted to rest on a metal pallet 60, (FIG. 4) to receive fill material. The mold open top allows it to receive fill up to a predetermined level in the cavity. The mold open bottom allows discharge of the molded fill material. After the mold is filled, the fill material is compacted by vibration and the action of a stripper shoe plate to a predetermined, compacted level corresponding with the finished height of the finished block. The mold also comprises an opposed, inwardly extending generally parallel upper lip 30 and lower lip 32 along at least one of the side walls 14. Preferably, the upper lip 30 is located at about the predetermined compacted fill level of the mold cavity 12, FIG. 2A. The lower lip 32 is located at the bottom of the mold cavity 12 (FIG. 2A).

Preferably, the upper and lower lips each extend from the side wall 14 into the cavity approximately 0.187 inches. The shape of the lower lip in cross section is preferably a wedge as shown in FIG. 2A. The presently preferred dimensions of the wedge are a thickness of about ¼ inch adjacent wall 14, and a thickness of about 1/16 inch at is outboard end. The presently preferred profile of the lower lip is that it be a straight outboard edge along its entire length. However, other shapes, such as serrated or scalloped, can be used to produce different roughened textures on the face of the finished masonry unit. In the presently preferred embodiment, the upper lip 30 is provided by means of a bar having a generally rectangular cross section which is affixed to side wall 14. The lower edge of this bar defines lip 30. In height it is presently preferred that this bar extend upwardly from the predetermined compacted fill level of the mold, to a point above the predetermined initial fill level of the mold. The clearance between the stripper shoe plate and the outboard end of the upper lip is preferably about 1/16 inch. I have had some success in producing satisfactory rough-textured blocks when the upper lip 30 is positioned below the compacted fill line of the mold, as well. In particular, I have made four inch high blocks with the upper and lower lips positioned only two inches apart with satisfactory results. A one inch spacing did not produce satisfactory results. The upper lip 30 may also include bevel 30'to guide the stripper shoe as it is inserted into the mold cavity during compression, FIG. 2B.

Both the upper lip 30 and lower lip 32 may be releasably attached to the side wall by means such as bolts, screws, etc. which allows for their removal. This is important because both the upper 30 and lower 32 lips are wear points in the mold apparatus and may after time wear, chip or break. Alternatively, the upper 30 and lower 32 lip may be welded to the mold side wall.

To use my invention, the mold 10 receives masonry fill to a predetermined initial fill level. Masonry fill generally is composed of aggregate such as sand and gravel, cement, and water.

The mold is then vibrated for several seconds, the time necessary to ensure the fill is uniformly spread throughout the mold. This vibrating may occur in concert with the compressive action of the stripper head 40 onto the fill 50 in the mold 10, FIG. 3. At this time the mold will then be vibrated for the time in which the head is compressed onto the fill. The combined action of the vibration and the stripper head lowers the level of the fill to a predetermined, compacted level, corresponding with the height of the finished unit.

The pressure applied by the stripper shoe ranges from about 1,000 to 8,000 psi and preferably is about 4,000 psi. Once the compression period is over the stripper shoe 40 in combination with the underlying pallet 60 acts to strip the blocks from the mold, FIG. 4. The lower lip 32 acts to strip fill 50' from the remainder of the masonry unit or block at what will become the roughened surface 45 of the block 50. This provides a masonry unit or block 50 having a roughened surface 45. The roughened texture produced has a shingled appearance with interspersed aggregate and pock marks. Once the molded fill material is stripped from the mold the block 50 is formed, FIG. 5.

Any of a number of vertically stripping block machines may be used in combination with my new mold. One such block machine which has been found useful in the formation of blocks is a Besser V-3/12 block machine. Other patents which I know of that are related to block forming include U.S. Pat. Nos. 5,249,950 and 5,062,610 which are both incorporated herein by reference.

Once the blocks are formed they may be cured through any means known to those with skill in the art. Curing mechanisms such as simple air curing, autoclaving, steam curing or mist curing are all useful methods of curing the block resulting from my invention.

The above discussions, examples and embodiments illustrated are current understanding of the invention, however, since many variations of the invention can be made with departing from the spirit and scope of the invention, the invention resides wholly in the claims hereafter appended.

What is claimed is:

1. A mold for producing a masonry unit with a roughened texture side surface comprising:

a) a plurality of side walls defining a mold cavity open at its top and bottom, adapted to receive masonry fill material by way of its open top, and to discharge molded fill material in the form of a molded masonry unit of predetermined height by way of its open bottom;

b) opposed, inwardly extending and generally parallel upper and lower lips along at least one of said side walls;

i) said lower lip being located at the bottom of the mold cavity;

ii) said upper lip being located at about said predetermined height above the lower lip; and wherein said upper lip and said lower lip project inwardly from said at least one side wall a substantially equal distance.

2. The mold of claim 1, wherein said lower lip is releasably attached to said at least one side wall.

3. The mold of claim 1, wherein the upper lip is releasably attached to said at least one side wall.

4., The mold of claim 1, wherein said upper lip has a top portion and a bottom portion, and its top portion includes a bevel adapted to act as an alignment guide.

5. A mold for producing a masonry unit with a roughened texture side surface comprising:

a) a plurality of side walls defining a mold cavity having an open top and an open bottom, the mold cavity adapted to receive masonry fill material by way of the open top and to discharge molded fill material in the form of a molded masonry unit of predetermined height by way of the open bottom;

b) opposed, inwardly extending and generally parallel upper and lower lips along at least one of said side walls;

i) said lower lip being located at the bottom of the mold cavity; and ii) said upper lip being located at about said predetermined height above the lower lip, and said upper lip extending continuously along said at least one side wall.

6. The mold of claim 5, wherein said lower lip is releasably attached to said at least one side wall.

7. The mold of claim 5, wherein said upper lip is releasably attached to said at least one side wall.

8. The mold of claim 5, wherein said upper lip has a top portion and a bottom portion, and its top portion includes a bevel adapted to act as an alignment guide.

* * * * *